US005199114A

United States Patent [19]

Christopher

[11] Patent Number: 5,199,114

[45] Date of Patent: Apr. 6, 1993

[54] DRAIN CLEARING DEVICE

[76] Inventor: Robert Christopher, 2146 W. Wellington Rd., Newtown, Pa. 18940

[21] Appl. No.: 722,846

[22] Filed: Jun. 28, 1991

[51] Int. Cl.[5] ..... E03D 9/00

[52] U.S. Cl. ..... 4/255.02; 4/255.01; 92/249; 92/258

[58] Field of Search ..... 4/255.01, 255.02, 255.03, 4/255.05, 255.11; 92/248, 249, 257, 258; 134/169 C; 417/63

[56] References Cited

U.S. PATENT DOCUMENTS

| | | | |
|---|---|---|---|
| 534,240 | 2/1895 | Aldrich | 4/255.02 |
| 1,684,880 | 9/1928 | Norton | 4/255.02 |
| 1,861,899 | 6/1932 | Beach, Jr. | 4/255.03 X |
| 2,658,809 | 11/1953 | Schultz | 92/258 |
| 3,066,003 | 11/1962 | Thassy | 92/258 |
| 3,155,015 | 11/1964 | Genz | 92/249 |
| 3,678,809 | 7/1972 | Doutt | 92/249 X |
| 3,703,125 | 11/1972 | Pauliukonis | 92/249 X |
| 3,983,958 | 10/1976 | Swearinger | 134/169 C |

FOREIGN PATENT DOCUMENTS

| | | | |
|---|---|---|---|
| 0745604 | 5/1933 | France | 4/255.02 |
| 0633348 | 12/1949 | United Kingdom | 4/255.02 |

*Primary Examiner*—William A. Cuchlinski, Jr.
*Assistant Examiner*—W. Morris Worth
*Attorney, Agent, or Firm*—Abdallah & Muckelroy

[57] ABSTRACT

A drain clearing device having a transparent and hollow cylindrical body, a piston plunger assembly partially disposed in the cylindrical body, piston plunger assembly support attached to an upper end of the cylindrical body, and a drain seal attached to a lower end of the cylindrical body. The drain seal is formed from medium density, closed cell sponge rubber.

4 Claims, 2 Drawing Sheets

DRAIN CLEARING DEVICE

BACKGROUND OF THE INVENTION

The present invention generally relates to drain clearing devices. More specifically, this invention relates to drain clearing devices which provide both positive and negative pressures to dislodge or remove foreign objects.

The most generally known type of drain clearing device is the hand-operated plunger comprising an elongated handle having a resilient, inverted-cup-shaped member secured to one end of the handle. By repeated collapse and release of the inverted-cup-shaped member while disposed in sealing engagement pressure under the member create an agitation that tends to dislodge clogging particles or foreign objects. The limited volume of air that can be trapped under the inverted-cup-shaped member renders this hand-operated plunger ineffective for removal of tightly-wedged clogs or large foreign objects.

Various means to improve the effectiveness of hand-operated plungers are disclosed in the prior art. U.S. Pat. No. 2,498,359 to Coleman discloses a hand-operated plunger device formed with a bore in the handle which receives a tube and a slidably supported valve-carrying body disposed in the tube. Selective positioning of the valve-carrying body above and below ports formed in the tube and handle permits selective use of the device as a pump or a plunger. U.S. Pat. No. 2,697,842 to Meyer discloses a combined hand and forced air pressure pump and plunger. The Meyer device can be used either as a pump, or as a plunger, by forcing trapped air from the device through a clogged drain A spring-loaded plunger is disclosed in U.S. Pat. No. 4,733,414 to Wilkes.

Another type of drain clearing device known in the art generally comprises a cylindrical body having a retractable piston plunger which draws water into the cylindrical body or forces water therefrom to dislodge a clog in a drain. In U.S. Pat. No. 2,456,092 to Storevik a drain clearing device of this type is disclosed which includes a pair of arcuate outlet pipes at an end of the cylindrical body which converge to an end pipe. A collar adapted to project from the end pipe into the clogged drain holds the device centered U.S. Pat. No. 3,641,597 to David et al. discloses a drain clearing device having a tubular body and a piston and rod assembly disposed therein. The piston of the assembly comprises a pair of adjacently-disposed frustoconical rubber rings. U.S. Pat. No. 3,934,280 to Tancredi discloses a further drain clearing device having a cylindrical body and a retractable piston plunger. A circumscribing radially-outwardly and upwardly flared flange is attached near the lower end of the cylindrical body to facilitate seating of the device in a drain. U.S. Pat. No. 4,186,451 to Ruo discloses an all-plastic drain clearing device of the retractable piston plunger type. In U.S. Pat. No. 4,674,137 to Girse a drain clearing device having a cylindrical body and a retractable piston plunger is disclosed which further includes controllable flutter type seals disposed on openings formed in the piston to adapt the device for selective conduction of positive or negative pressure forces through the clogged drain A lateral outlet pipe is attached to the top portion of the cylindrical body for discharge of fluid and debris removed from the drain.

While the drain clearing devices of the prior art provide means for selective development of positive and negative pressure forces, none of the references cited provide sealed visual means for observing when a foreign object or clogged debris is removed from the drain. Thus, to determine if a drain is unclogged the prior art devices require continual removal of the device from the drain, checking of the drain flow, for example by flushing a commode, and subsequent repositioning of the device in appropriate sealing engagement The inefficiency of this method of clearing a drain is costly, in particular where commercial plumbers and the like are utilized The prior art drain clearing devices also generally function to loosen a clog instead of completely removing the clog from the drain, in part because it cannot be readily determined when the clog has been removed. Complete removal of a clog from a drain prevents further obstruction of the drain through subsequent re-entry of the clogging debris or foreign object. Prior art drain clearing devices also splash water during unclogging operations which necessitates cleaning of the surrounding floor and inhibits operation of the device when the user is nattily attired A further limitation of the prior art drain clearing devices is the failure to maintain sealing engagement of the device with the surface surrounding the drain. These and other limitations and disadvantages of the prior art drain clearing devices are overcome by the drain clearing device of the present invention.

SUMMARY OF THE INVENTION

The present invention is a drain clearing device generally comprising a transparent cylindrical body having a piston plunger assembly slidably and sealingly disposed therein, piston plunger assembly support means attached to an upper end of the cylindrical body and a drain seal attached to a lower end of the cylindrical body. A preferred embodiment of the drain seal comprises a half doughnut-shaped drain seal head formed from medium density, closed cell sponge rubber, a drain seal head bearing plate fixedly attached to the drain seal head, and a drain seal neck fixedly attached to the drain seal head bearing plate. Drain seal neck attaches to the cylindrical body in sealing engagement.

An object of the present invention is to provide a drain clearing device having means to visually observe the dislodge of clogging debris or foreign objects from a drain.

Another object of the present invention is to provide means to completely remove clogging debris or the like from a drain.

A further object of this invention is to provide a drain clearing device that sufficiently seals the device about a drain opening to facilitate vacuum operation of the device.

A still further object of the present invention is to eliminate water splashing during a drain clearing operation.

These and other objects and advantage of the present invention will be apparent to those skilled in the art from the following description of preferred embodiments, claims and appended drawings

DESCRIPTION OF PREFERRED EMBODIMENTS

Figure 1:
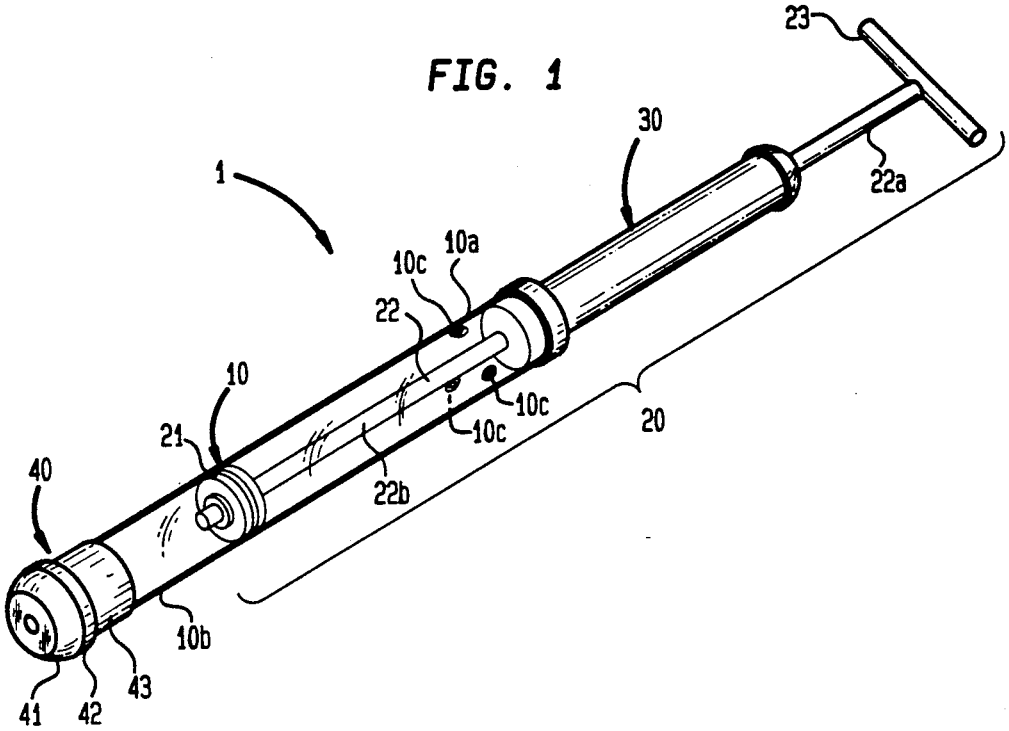
FIG. 1 is a perspective view of the first preferred drain clearing device of the present invention.

FIG. 1 illustrates in a perspective view a first preferred embodiment of the drain clearing device 1 of the present invention. First drain clearing device 1 generally comprises a transparent lower cylinder 10, a piston plunger assembly 20 partially disposed within the lower cylinder 10, piston plunger assembly support means 30 disposed at an upper end 10*a* of the lower cylinder 10 and a first drain seal 40 disposed at a lower end 10*b* of the lower cylinder 10. A plurality of vent holes 10*c* are formed in lower cylinder 10 proximate the upper end 10*a* thereof, preferably including three vent holes 10*c* equally spaced about cylinder 10.

Piston plunger assembly support means 30 is disposed in sealing engagement with the upper end 10*a* of the lower cylinder 10 and receives the piston plunger assembly 20 in slidable engagement as hereinafter described in greater detail. First drain seal 40 is disposed in sealing engagement with the lower end 10*b* of the lower cylinder 10, also described hereinafter in greater detail.

Transparent lower cylinder 10 is preferably formed from a clear, spun acrylic resin as generally known for use in cast and molded parts. Piston plunger assembly 20 of the first drain clearing device 1 comprises a first piston 21, a first piston rod 22 and a piston rod handle 23. First piston 21 is fixedly attached to a lower end 22*b* of first piston rod 22 and piston rod handle 23 is fixedly attached to an upper end 22*a* of first piston rod 22. The peripheral sides of the first piston 21 are disposed in slidable contact with the inside wall of the lower cylinder 10. Piston rod 22 extends from its attachment with first piston 21 within the lower cylinder 10 through the piston plunger assembly support means 30 to the piston rod handle 23.

First drain clearing device 1 is operated to unclog a drain by disposing the first drain seal 40 in sealing engagement about a drain opening and pumping first piston 21 by up and down movement of handle 23 to create positive and negative pressure forces in the drain. The clogging debris or foreign object is drawn into the transparent lower cylinder 10 where it can be immediately seen when removed from the drain.

Figure 2:
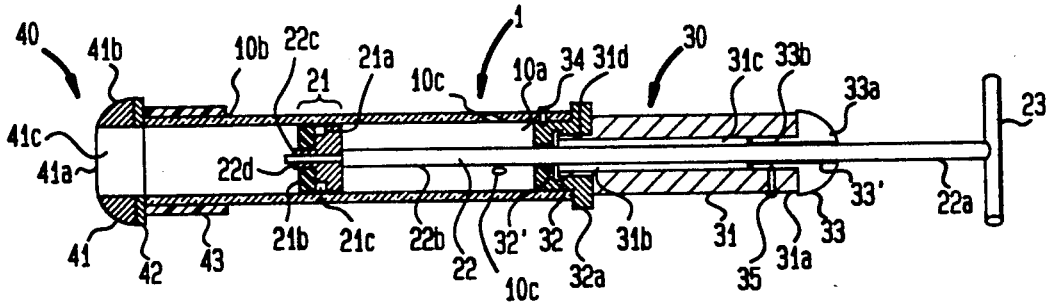
FIG. 2 is a longitudinal cross-sectional view of the drain clearing device illustrated in FIG. 1.

FIG. 2 illustrates a longitudinal cross-sectional view of the first drain clearing device 1. Therein it can be seen that piston plunger assembly support means 30 includes an upper cylinder 31, a cylinder reducer 32 and an end bell 33. Upper cylinder 31 is formed having a longitudinal bore 31*c* extending therethrough and a reduced section 31*d* at the lower end 31*b* thereof End bell 33 is disposed in the longitudinal bore 31*c* of the upper cylinder 31 at the upper end 31*a* of the upper cylinder 31 The reduced section 31*d* of the upper cylinder 31 is received in frictional engagement in the cylinder reducer 32.

Cylinder reducer 32 is preferably formed from polyvinyl chloride (PVC) or similar material and includes an annular reducer flange 32*a* which fits atop the upper end 10*a* of the lower cylinder 10. Cylinder reducer 32 receives the reduced section 31*d* of the upper cylinder 31 in frictional engagement. Cylinder reducer 32 is held fixedly attached to lower cylinder 10 by reducer screw fastener means 34, preferably comprising a plurality of equally-spaced set screws which engage the upper end 10*a* of lower cylinder 10 and the cylinder reducer 32.

End bell 33 is preferably formed from polyvinyl chloride (PVC) or similar material and includes a lower portion 33*b* which engages the longitudinal bore 31*c* of the upper cylinder 31 and a bell head portion 33*a* which fits atop the upper end 31*a* of the upper cylinder 31. End bell 33 is similarly held fixedly attached to upper cylinder 31 by bell screw fastener means 35, preferably comprising a plurality of equally-spaced set screws which engage the upper cylinder 31 and the lower portion 33*b* of the end bell 33. Vertically-aligned reducer and end bell apertures 32' and 33' are respectively formed in cylinder reducer 32 and end bell 33 for receipt of the piston rod 22 in sliding engagement. Reducer aperture 32' and the end bell aperture 33' retain the piston plunger assembly 20 in vertical alignment within the first drain clearing device 1.

First piston 21 preferably comprises a three-part piston assembly preferably formed from dense rubber material and including a main piston portion 21*a*, an end piston portion 21*b* and a piston ring 21*c* sandwiched between the main piston portion 21*a* and the end piston portion 21*b*. Main piston portion 21*a* is formed having first and second reduced sections which respectively receive the piston ring 21*c* and end piston portion 21*b*. First piston rod 22 includes a reduced end section 22*c* which receives the main piston portion 21*a* of first piston 21. Main piston portion 21*a*, piston ring 21*c* and end piston portion 21*b* are retained on first piston rod 22 by means of a first piston rod retaining ring 22*d*.

First drain seal 40 includes a drain seal head 41, a drain seal head bearing plate 42 and a drain seal neck 43. Drain seal head 41 is preferably formed from medium density, closed cell sponge rubber having a half-doughnut shape. The half-doughnut shape of drain seal head 41 should be understood to comprise a member having a flat central end portion 41*a* which extends to arcuate side walls 41*b*. The closed cell sponge rubber construction of drain seal head 41 permits the first drain seal 40 to adjust to imperfections in the surface surrounding a drain opening thereby assuring sealing engagement of the first drain clearing device 1 with the clogged drain. A drain sealing opening 41*c* corresponding in diameter to the inside diameter of lower cylinder 10 extends through drain seal head 41 and drain seal head bearing plate 42 to communicate with the interior of lower cylinder 10. Drain seal head bearing plate 42 and drain seal neck 43 are preferably formed from polyvinyl chloride (PVC) or similar material in a unitary construction. Drain seal neck 43 attaches to the lower end 10*b* of the lower cylinder 10 in frictional engagement. The flexible construction of drain seal head bearing plate 42 permits use of the first drain clearing device 1 in variously-configured drains and drain openings.

Figure 3:
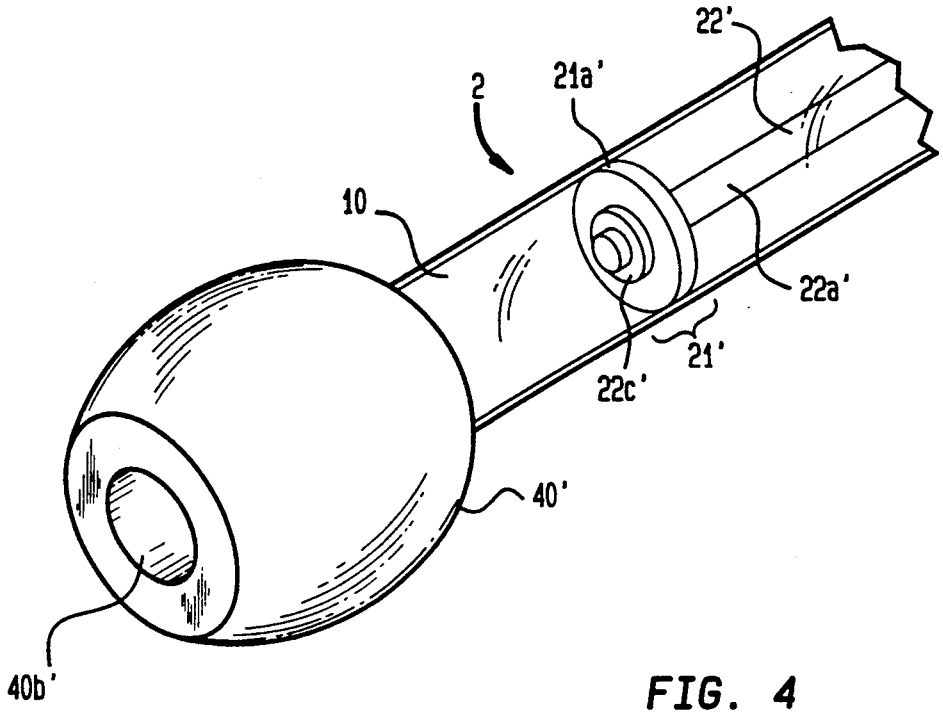
FIG. 3 is a perspective view of a second preferred embodiment of a drain seal assembly for the drain clearing device of the present invention.
Figure 4:
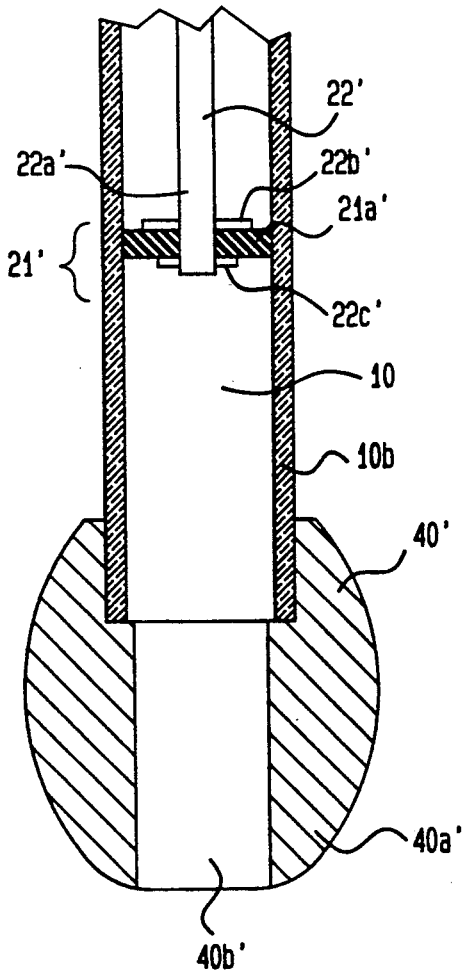
FIG. 4 is a lateral cross-sectional view of the drain seal assembly illustrated in FIG. 3.

FIG. 3 illustrates in a fragmentary perspective view a second drain clearing device 2 constructed in accordance with the teachings of the present invention. Second drain clearing device 2 is constructed substantially similar to the first drain clearing device 1 illustrated in FIGS. 1 and 2 with the exception that alternative second piston 21', second piston rod 22' and second drain seal 40' constructions are provided. Second piston 21' comprises a single O-ring 21*a*', preferably formed from silicone, fixedly disposed at a lower end 22*a*' of second piston rod 22' O-ring 21*a*' is held in place at the lower end 22*a*' of second piston rod 22' by means of a locking plate 22b' (FIG. 4) disposed to one side of O-ring 21a' and a second piston rod retaining ring 22c' disposed to the opposite side of O-ring 21a'.

Second drain seal 40' comprises a bulbous member having a half-doughnut head portion 40a' formed substantially as previously described for the drain seal head 41 of first drain clearing device 1. A second seal drain opening 40b' extends through the second drain seal 40' to communicate with the interior of lower cylinder 10. Second drain seal 40' attaches in sealing engagement with the lower end 10b of lower cylinder 10. Second drain seal 40' is preferably formed from medium density, closed cell sponge rubber to facilitate sealing engagement of the second drain clearing device 2 as heretofore described.

Various changes and modifications may be made to the foregoing preferred embodiments of the present invention without departing from the spirit and scope of the present invention. Such changes and modifications within a fair reading of the following claims are intended as part of the present disclosure.

Therefore, in view of the foregoing I claim:

1. A drain clearing device comprising a transparent and hollow first cylindrical body having an open upper end and an open lower end and at least one vent hole, a piston plunger assembly including a piston slidably and sealingly disposed within the first cylindrical body, a piston rod fixedly attached at one end to said piston, said piston rod having a piston rod handle fixedly attached to the opposite end of said piston rod, support means for supporting said piston plunger assembly, said support means being fixedly attached to the upper end of the first cylindrical body, said piston rod being receivable in slidable engagement in said assembly support means, a drain seal attached to the lower end of the first cylindrical body in sealing engagement, said drain seal including a drain seal opening communicating with the first cylindrical body, said piston comprising a three-part piston assembly including a main piston portion, an end piston portion and a piston ring sandwiched between the main piston portion and the end piston portion, said main piston portion being formed having first and second reduced sections which respectively receive the piston ring and the end piston portion, said main piston portion, piston ring and the end piston portion being retained and attached to the piston rod by means of a retaining ring.

2. A drain clearing device comprising a transparent and hollow first cylindrical body having an open upper end and an open lower end and at least one vent hole, a piston plunger assembly including a piston slidably and sealingly disposed within the first cylindrical body, a piston rod fixedly attached at one end to said piston, said piston rod having a piston rod handle fixedly attached to the opposite end of said piston rod, support means for supporting said piston plunger assembly, said support means being fixedly attached to the upper end of the first cylindrical body, said piston rod being receivable in slidable engagement in said assembly support means, a drain seal attached to the lower end of the first cylindrical body in sealing engagement, said drain seal including a drain seal opening communicating with the first cylindrical body, said support means for said piston plunger assembly further comprising a second cylindrical body, a cylindrical reducer and an end bell, said second cylindrical body having a longitudinal bore extending therethrough and a reduced section formed at a lower end thereof, said cylindrical reducer having a receiving means for receiving the reduced section of the second cylindrical body, said cylindrical reducer being formed having an annular reducer flange which fits atop the upper end of the first cylindrical body, said cylindrical reducer being fixedly attached to said first cylindrical body by reducer screw fastener means which engage the upper end of the first cylindrical body, said reduced section of said second cylindrical body being receivable in said cylinder reducer in frictional engagement, said end bell being formed having a lower portion which engages the longitudinal bore of said second cylindrical body and a bell head portion which fits atop the upper end of the second cylindrical body, said end bell being fixedly attached to said second cylindrical body by bell screw fastener means which engage the second cylindrical body and the end bell, vertically-aligned reducer and end bell apertures being respectively formed in the cylindrical reducer and the end bell for receipt of the piston in sliding engagement.

3. A drain clearing device comprising:

a transparent and hollow first cylindrical body having an open upper end and an open lower end and at least one vent hole, said first cylindrical body being formed from clear, spun acrylic resin; a piston plunger assembly including a piston slidably and sealingly disposed within the first cylindrical body, a piston rod fixedly attached at one end to said piston and having a piston rod handle fixedly attached to the opposite end of said piston rod, said piston comprising a silicone O-ring fixedly attached at a lower end of sid piston rod;

support means for supporting said piston plunger assembly fixedly attached to the upper end of the first cylindrical body, said piston rod being receivable in slidable engagement in said support means, said piston plunger assembly support means comprising a second cylindrical body, a cylinder reducer and an end bell, said cylinder reducer and said end bell being formed form polyvinyl chloride material, said second cylindrical body having a longitudinal bore extending therethrough and a reduced section formed at a lower end thereof, said cylindrical reducer having a receiving mean for receiving the reduced section of the second cylindrical body, said cylinder reducer being formed having an annular reducer flange which fits atop the upper end fo the first cylindrical body, said cylinder reducer being fixedly attached to said first cylindrical body by reducer screw fastener means comprising a plurality of equally-spaced set screws which engage the upper end of the first cylindrical body, said reduced section of said second cylindrical body being receivable in said cylinder reducer in frictional engagement, said end bell being formed having a lower portion which engages the longitudinal bore of said second cylindrical body and a bell head portion which fits atop an upper end of the second cylindrical body, said end bell being fixedly attached to said second cylindrical body by bell screw fastener means comprising a plurality of equally-spaced set screws which engage the second cylindrical body and the end bell, vertically-aligned reducer and end bell apertures being respectively formed in the cylinder reducer an the end bell for receipt of the piston rod in sliding engagement; and a drain seal attached to the lower end of the first cylindrical body in sealing engagement, said drain seal comprising a drain seal head, a drain seal head bearing plate fixedly attached to said drain seal head, and a drain seal neck integrally formed with the drain seal head bearing plate, a drain seal opening extending through the drain seal communicating with the first cylindrical body, said drain seal head being formed from medium density, closed cell sponge rubber having a half-doughnut shape, said half-doughnut shape of said drain seal head substantially comprising a member having a flat central end portion which extends to arcuate side walls, the drain seal head bearing plate being attached to said drain seal head opposite to said flat central end portion, said drain seal head bearing plate and said drain seal neck being formed from polyvinyl chloride material, said drain seal neck being attachable in sealing engagement with the lower end of the first cylindrical body.

4. A drain clearing device comprising:

a transparent and hollow first cylindrical body having an open end and an open lower end and at least one vent hole, said first cylindrical body being formed from clear, spun acrylic resin;

a piston plunger assembly including a piston slidably and sealingly disposed within the first cylindrical body, a piston rod fixedly attached at one end to said piston and having a piston rod handle fixedly attached to the opposite end of said piston rod, said piston comprising a three-part piston assembly including a main piston portion, an end piston portion and a piston ring sandwiched between the main piston portion and the end piston portion, said main piston portion being formed having first and second reduced sections which respectively receive the piston ring and the end piston portion, said main piston portion, piston ring and end piston portion being retained attached to the piston rod by means of a retaining ring, said piston assembly being formed from dense rubber material;

support means for supporting said piston plunger assembly fixedly attached to the upper end of the first cylindrical body, said piston rod being receivable in slidable engagement in said support means, said piston plunger assembly support means comprising a second cylindrical body, a cylinder reducer and an end bell, said second cylindrical body having a longitudinal bore extending therethrough and a reduced section formed at a lower end thereof, said cylindrical reducer having a receiving means for receiving the reduced section of the second cylindrical body, said cylinder reducer being formed having an annular reducer flange which fits atop the upper end of the first cylindrical body, said cylinder reduced being fixedly attached to said first cylindrical body by reducer screw fastener means which engage the upper end of the first cylindrical body, said reduced section of said second cylindrical body being receivable in said cylinder reducer in frictional engagement.

said end bell being formed having a lower portion which engages the longitudinal bore of said second cylindrical body and a bell head portion which first atop an upper end of the second cylindrical body, said end bell being fixedly attached to said second cylindrical body by bell screw fastener means which engage the second cylindrical body and the end bell, vertically-aligned reducer and end bell apertures being respectively formed in the cylinder reducer and the end bell for receipt of the piston rod in sliding engagement, said cylinder reducer and said end bell are formed from polyvinyl chloride material; and a drain seal attached to the lower end of the first cylindrical body in sealing engagement, said drain seal including a drain seal opening communicating with the first cylindrical body, said drain seal comprising a bulbous member formed from medium density, closed cell sponge rubber and having an integrally-formed half-doughnut head portion, said half-doughnut head portion substantially comprising a flat central end portion which extends to arcuate side walls, said bulbous member being attachable to said first cylindrical body opposite to said flat central portion.

* * * * *